US007249432B2

(12) United States Patent
Lewis

(10) Patent No.: US 7,249,432 B2
(45) Date of Patent: Jul. 31, 2007

(54) VEHICLE LOCATOR AND IDENTIFICATION CARD

(75) Inventor: Mark W. Lewis, Greenville, SC (US)

(73) Assignee: Marjen, Inc., Greenville, SC (US)

( * ) Notice: Subject to any disclaimer, the term of this patent is extended or adjusted under 35 U.S.C. 154(b) by 237 days.

(21) Appl. No.: 11/007,509

(22) Filed: Dec. 8, 2004

(65) Prior Publication Data

US 2006/0117631 A1 Jun. 8, 2006

Related U.S. Application Data

(63) Continuation-in-part of application No. 10/860,459, filed on Jun. 3, 2004.

(51) Int. Cl.
*G09F 3/10* (2006.01)

(52) U.S. Cl. ..... 40/673; 40/634

(58) Field of Classification Search ..... 40/6, 40/330, 634, 674

See application file for complete search history.

(56) References Cited

U.S. PATENT DOCUMENTS

| | | | | |
|---|---|---|---|---|
| 2,578,548 | A * | 12/1951 | Histed | 40/665 |
| 3,532,574 | A * | 10/1970 | Davis | 156/238 |
| 4,379,012 | A * | 4/1983 | Heymanns | 156/157 |
| D272,368 | S * | 1/1984 | Fontaine | D20/27 |
| 4,726,131 | A * | 2/1988 | Cass | 40/638 |
| 4,846,501 | A | 7/1989 | Del Grande | 282/9 R |
| 4,907,359 | A | 3/1990 | Berman | 40/299 |
| 5,782,497 | A | 7/1998 | Casagrande | 283/110 |
| 6,352,287 | B2 | 3/2002 | Casagrande | 283/81 |
| 6,352,608 | B1 | 3/2002 | Garden | 156/249 |
| 6,898,880 | B2 * | 5/2005 | Best et al. | 40/299.01 |

* cited by examiner

*Primary Examiner*—Joanne Silbermann
(74) *Attorney, Agent, or Firm*—Charles L. Schwab; Nexsen Pruet, LLC

(57) ABSTRACT

A vehicle identification and locator card for vehicle parking and servicing establishments includes an upper portion made of paper board and a lower portion made of synthetic paper. An ignition key tag is die cut from the lower synthetic paper portion, which retains its strength when wet. The lower portion has a backing of a dry release laminate patch. The lower portion may be attached to the upper portion by an adhesive tape or it made be attached by having a part of the dry release laminate patch extend beyond the lower portion and beneath the upper portion.

6 Claims, 3 Drawing Sheets

VEHICLE LOCATOR AND IDENTIFICATION CARD

CROSS REFERENCE TO RELATED APPLICATION

This application is a continuation-in-part patent application of co-pending U.S. patent application Ser. No. 10/860,459 filed Jun. 3, 2004 for a Vehicle Locator and Identification Card, the benefit of which is claimed.

BACKGROUND OF THE INVENTION

Businesses concerned with parking or servicing vehicles have a problem of correlating the ignition key and the vehicle owner with a particular vehicle. Paper cards with three segments separated by perforations and carrying the same number have been provided so that one segment serves as a claim check, a second segment is placed in the vehicle and a third segment has a key ring stapled to it. A computer type multiple copy form with perforated tear-off strips has been proposed for correlation of ignition key, vehicle and customer which includes perforation lines permitting separation of the form into sections—one to be placed on the vehicle, one to be connected to the ignition key in some undisclosed manner and one to be given to the automobile owner as a claim check. The vehicle locator and identification card disclosed in the above identified related patent application included an arrow shaped vehicle key tag, which is die cut from the lower segment of the paper card. In use, particularly in inclement weather, it has been found that the paper vehicle key tag can become wet; causing it to lose strength, thereby increasing the risk of it breaking and a consequential loss of the key.

BRIEF DESCRIPTION OF THE INVENTION

The upper two segments of a three part automotive vehicle locator card are formed from a thick sheet of pliable paperboard material and the lower vehicle key tag segment is made of synthetic paper, which retains its strength when wet. A matching identification number is printed on the three segments of the card. The three segments are established by perforations or slits which permit the segments to be easily separated from one another. A large upper segment of the card includes a punched out hole and a slit from an edge of the card to the hole which permits the upper segment to be attached to the rear view mirror bracket of the vehicle. A second segment of the card is a customer's claim check. A third segment of the card includes a synthetic paper portion which is at least partially laminated by a dry release laminate patch. A removable arrow shaped key tag is defined by cuts within the laminated area of the synthetic portion of the third segment of the card. Upon removal of the key tag, the head of the arrow is inserted into a T-shaped slot in the tail of the arrow to form a ring for holding an ignition key. The synthetic paper of which the key tag is formed does not lose its strength upon becoming wet, thereby greatly reducing the risk of loss of the key.

BRIEF DESCRIPTION OF THE DRAWINGS

An embodiment of the invention is shown in the accompanying drawings in which.

DETAILED DESCRIPTION OF THE INVENTION

Figure 1:
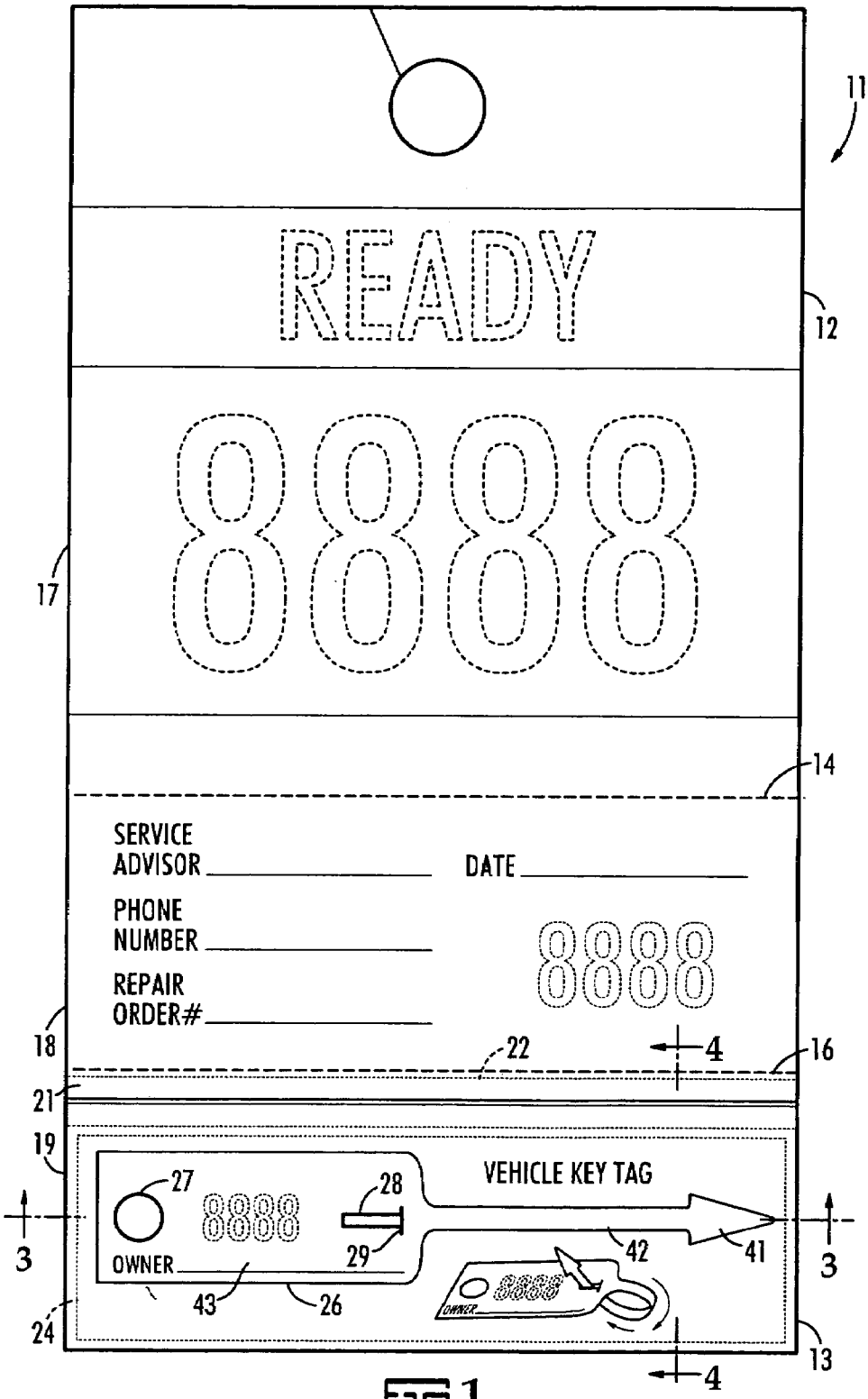
FIG. 1 shows the front of a vehicle locator and identification card.

The automotive vehicle locator card 11 shown in FIG. 1 includes a relatively thick pliable paperboard sheet 12, forming an upper portion, and a lower portion 13 made of synthetic paper. The paperboard sheet 12 is perforated by cuts, or die cut substantially through its thickness, along lines 14, 16 thereby defining and permitting easy separation of three segments 17, 18, 19 of the card 11. The upper segment 17 is attached to the vehicle. The intermediate segment 18 is the customer's claim check with customer satisfaction question on its back side. The lower segment 19 includes a narrow bottom part 21 of the paperboard sheet 12 and the lower portion 13 made of synthetic paper, such as 5 SPW Spectralite synthetic paper made by Multi-Plastics, Inc. of Lewis Center, Ohio, USA. 5 SPW Spectralite synthetic paper is polypropylene film reinforced with other fillers to enhance the white, opaque surface.

Figure 2:
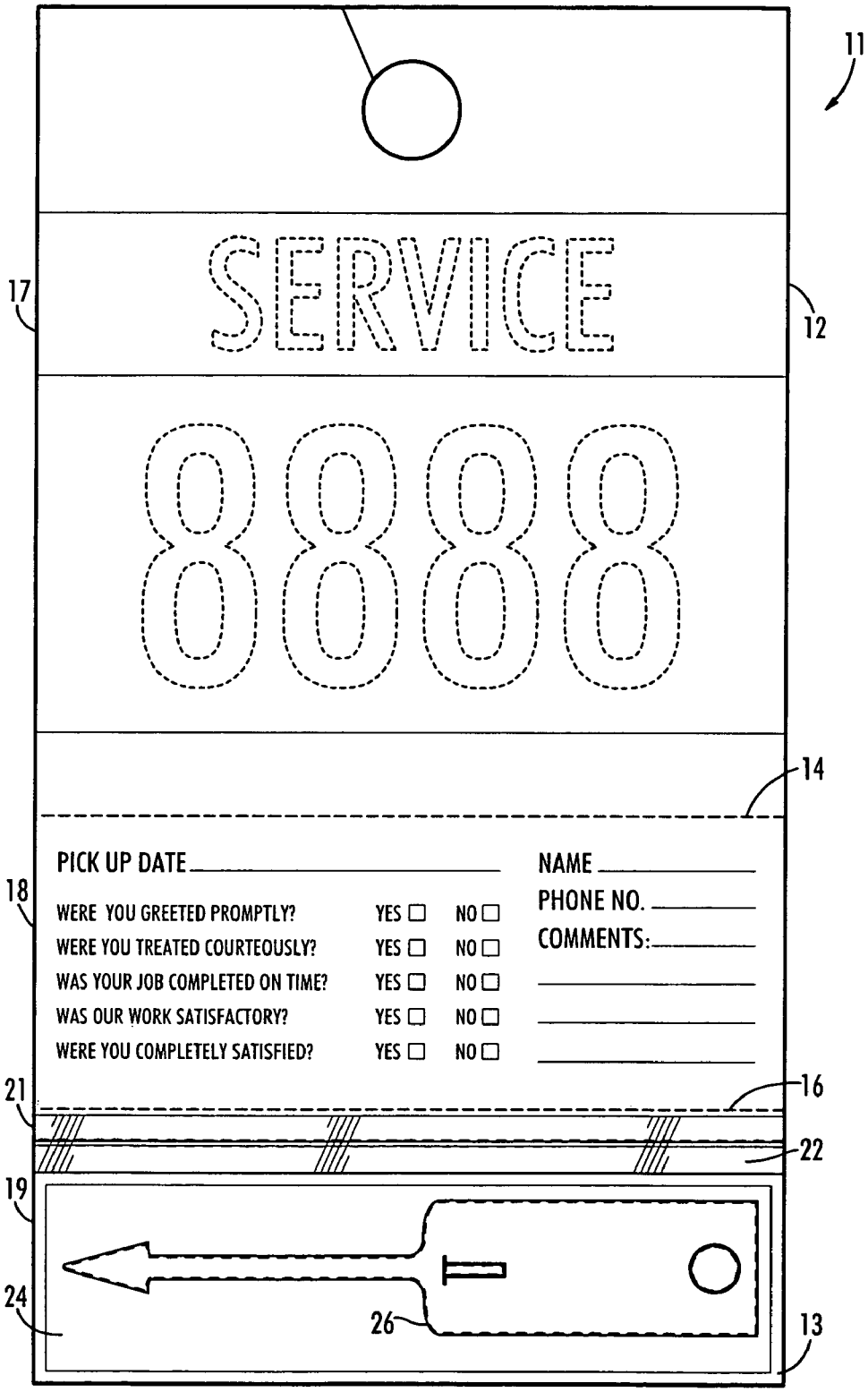
FIG. 2 shows the rear of the card shown in FIG. 1.
Figure 3:
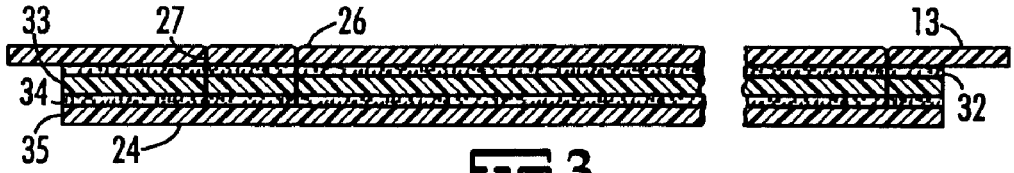
FIG. 3 is an enlarged section taken on line 3-3 in FIG. 1 with parts broken away for illustration purposes.
Figure 4:
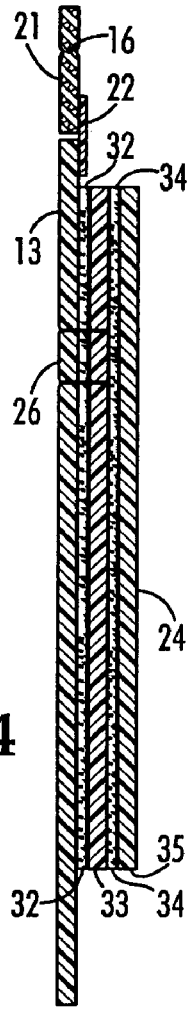
FIG. 4 is an enlarged section taken on the line 4-4 in FIG. 1.
Figure 6:
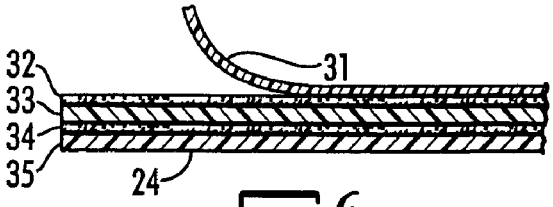
FIG. 6 illustrates removal of a clean release protective layer from a laminate patch.

As shown in FIGS. 1, 2 and 4 the synthetic paper portion 13 is secured to the part 21 of the paperboard sheet 12 in an end to end relationship by an adhesive tape 22. Referring to FIGS. 2, 3 and 4, a dry release laminate patch 24 is applied to the back side of the synthetic paper portion 13. The dry release laminate patch 24 may be formed of DLC 050, a Lite Lift Dry product of Strata-Tac Inc. of Batavia Ill., USA, which has a 2 mil thickness. The thickness of the layers of the patch in the drawings is exaggerated for illustration purposes. As shown in FIG. 6, the laminate patch 24, as supplied by the manufacturer, has a protective cover layer 31, an adhesive layer 32, a plastic layer 33, a dry release adhesive layer 34 and a bottom plastic layer 35. Prior to applying the patch 24 to the synthetic paper portion 13, the protective layer 31 is removed, as shown in FIG. 6, thus exposing adhesive layer 32 which affixes the plastic layer 33 to the synthetic paper portion 13 covering the area thereof from which a key tag 26 is formed. The arrow shaped vehicle key tag 26 is formed by die cutting through the portion 13 and the plastic layer 33, but not through the bottom layer 35. The key tag 26 has a head 41, a shank 42 and a tail 43. The die cutting process not only forms the outer edges of the tag 26 but also forms an opening 27 and a T shaped slot consisting of a narrow channel 28 extending parallel to the shank 42 and a slit 29 at one end of the channel 28. The slit 29 is transverse to the channel 28 and extends laterally beyond the channel 28 in laterally opposite directions. The slit 29 is as long as the width of the shank 42 of the key tag 26 and the head 41 of the key tag 26 is wider than the length of the slit 29. In use, an ignition key is placed on the shank 42 of the key tag 26, the head 41 is passed through the channel 28 and the shank 42 is pulled into the slit 29. By forming the key tag 26 of a layer of the synthetic paper portion 13 and a layer of the plastic 33, the key tag 26 is rendered stronger to resist tearing.

Figure 5:
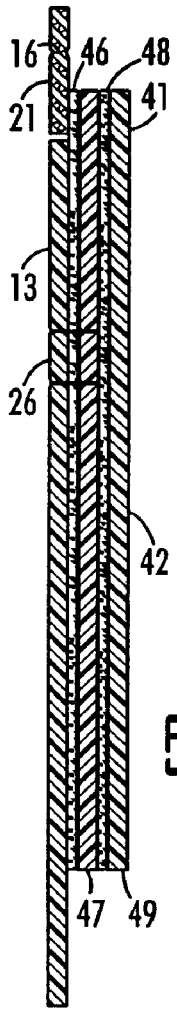
FIG. 5 is a section similar to FIG. 4 showing an alternate construction.

FIG. 5 shows an alternate construction in which the upper part 41 of a dry release laminate patch 42 extends beyond the synthetic paper portion 13 and adheres to the underside of the portion 21 of the paperboard sheet 12. This embodiment of the invention eliminates the need for the tape 22.

The vehicle locator card 11 with its three segments 17, 18, 19 carrying the same identification indicia and easily separated into segments for placement in the vehicle, for a claim check and for a key tag, helps parking and servicing establishments provide prompt and accurate customer service. By using of synthetic paper for the lower portion 13, the key tag 28 does not lose strength when it becomes wet, the head of the arrow of the key ring 26 remains in the T shaped slot and the key remains attached to the key tag.

What is claimed is:

1. A vehicle locator card, comprising:

an upper portion formed of a sheet of paperboard, a lower portion formed of synthetic paper which retains it strength when wet and including cuts in said synthetic paper forming an arrow shaped key tag, said upper portion and said arrow shaped key tag carrying the same vehicle identification indicia, a dry release laminate patch on one side of said lower portion covering one side of said key tag, said key tag being hand removable from said lower portion and said dry release laminate patch, and a tape securing said lower portion to said upper portion in an end to end relationship.

2. The vehicle locator card of claim 1 wherein said arrow shaped key tag includes an arrow shaped head, a shank and a tail having a T-shaped slot formed by a channel parallel to said shank and a slit at the end of the channel nearest to said head for receiving said shank when said head is inserted through said channel.

3. The vehicle locator card of claim 2 wherein said channel is narrower than the width of said shank.

4. A vehicle locator card, comprising:

an upper portion formed of a sheet of paperboard, a lower portion formed of synthetic paper which retains its strength when wet, a tape securing said lower portion to said upper portion in an end to end relationship a dry release laminate patch adhered on one side of said lower portion, said patch having a bottom plastic layer and a top plastic layer, an adhesive on top of said top plastic layer and a dry release adhesive between said top and bottom layers, and die cuts through said lower portion and through said top layer of said patch forming a key tag, said key tag being hand removable from said lower portion and from said dry release laminate patch, said upper portion and said key tag carrying the same vehicle identification indicia.

5. The vehicle locator card of claim 4 wherein said die cuts form an arrow shaped key tag with an arrow shaped head, a shank and a tail having a T-shaped slot formed by a channel parallel to said shank and a slit at the end of said channel nearest to said head for receiving said shank when said head is inserted through said channel to form a ring for an ignition key.

6. The vehicle locator card of claim 5 wherein said channel is narrower than the width of said shank.

* * * * *